US006928681B1

(12) United States Patent
Stacy

(10) Patent No.: US 6,928,681 B1
(45) Date of Patent: Aug. 16, 2005

(54) ALTERNATING PRESSURE PADS

(75) Inventor: Peter Charles Stacy, Dorset (GB)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/083,714

(22) Filed: May 22, 1998

Related U.S. Application Data

(63) Continuation of application No. PCT/GB96/02895, filed on Nov. 25, 1996.

(30) Foreign Application Priority Data

Nov. 23, 1995 (GB) ..... 9523990
Dec. 18, 1995 (GB) ..... 9525814

(51) Int. Cl.[7] ..... A47C 27/08
(52) U.S. Cl. ..... 5/713; 5/710; 5/714
(58) Field of Search ..... 5/713, 710, 714, 5/914, 715, 654, 655.3; 137/565.33

(56) References Cited

U.S. PATENT DOCUMENTS 4,391,009 A * 7/1983 Schild et al. ..... 5/453
5,003,654 A * 4/1991 Vrzalik ..... 5/453
5,109,560 A * 5/1992 Uetake ..... 5/713
5,109,561 A * 5/1992 Schild ..... 5/713
5,117,518 A * 6/1992 Schild ..... 5/713
5,142,717 A * 9/1992 Everard et al. ..... 5/713 X
5,189,742 A * 3/1993 Schild ..... 5/713
5,396,671 A 3/1995 Stacy ..... 5/455

FOREIGN PATENT DOCUMENTS

WO WO 89/08438 9/1989 ..... A61G/7/04

* cited by examiner

*Primary Examiner*—Terry Lee Melius
*Assistant Examiner*—Rodrigo J. Morales

(57) ABSTRACT

An alternating pressure pad comprises at least two sets of inflatable cells, an air supply line to each set, a pump to circulate pressurized air through a circuit including the sets of cells and to return air from the cells to the pump, valve means for alternately causing inflation and deflation of each set, a sensor pad in the circuit through which pressurized air is passed and detecting means for detecting a reduction in air flow through the sensor pad to a level below a predetermined level and for increasing air pressure in the sets of cells to restore the air flow to a level above the predetermined level.

11 Claims, 2 Drawing Sheets

ALTERNATING PRESSURE PADS

RELATED APPLICATIONS:

This application is a continuation of PCT international application Ser. No. PCT/GB96/02895 filed Nov. 25, 1996, which designates the United States and claims priority to British patent application No. 9523990.1 filed Nov. 23, 1995 and British patent application No. 9525814.1 filed Dec. 18, 1995.

FIELD OF THE INVENTION

The present invention relates to alternating pressure pads. More particularly, the invention relates to alternating pressure pads for use in nursing patients and others prone to bed sores.

BACKGROUND OF THE INVENTION

Alternating pressure pads are known and have been used in the construction of mattresses, chairs, couches and other patient support devices to improve blood circulation, and thereby reduce the incidence of bed sores.

U.S. Pat. No. 5,396,671 discloses an alternating pressure pad particularly designed for use as a mattress, in which two sets of inflatable cells are alternately inflated and deflated in order to stimulate blood circulation in a patient lying on the mattress. In this U.S. patent, a sensor pad is located beneath the inflatable cells in order to detect when the cells are insufficiently inflated. One described sensor comprises a flexible tube positioned beneath the mattress. One end of this tube is connected to the inflatable cells and the other discharges to atmosphere, thus providing a continuous leakage path. In the event that inflation pressure in the cells becomes insufficient to maintain the user above a base surface, the sensor tube will be compressed, reducing or entirely cutting off the flow of air therethrough. As a result, more air will become available to the cells and the user will be raised off the base surface, thereby releasing the compression of the tube and restoring the controlled leak through the sensor tube. While simple in operation, a sensor tube of this kind has the disadvantage that there is a constant loss of air from the system which necessitates the continuous operation of a higher capacity pump than would be required if such a leak could be avoided.

SUMMARY OF THE INVENTION

According to one aspect of the present invention there is provided an alternating pressure pad having a sensor pad in which the sufficiency of inflation of the cells is sensed by detecting the change of pressure or air flow through the sensor pad or through conduits leading to it.

According to another aspect of the present invention, therefore, there is provided an alternating pressure pad which comprises at least two sets of inflatable cells, an air supply line to each set, a pump to alternately circulate pressurized air through a circuit including the sets of cells and to return air from the cells to the pump, the sensor pad in said circuit through which pressurized air is passed and a detecting means for detecting a reduction below a predetermined level of air flow through the sensor pad and for increasing air pressure in said sets of cells to restore the air flow to above said predetermined level.

The reduction in air flow through the sensor pad caused by the patient's weight compressing the sensor pad can be detected by sensing the change of air pressure in the sensor pad or in conduits connecting the pad to the circuit.

A sensor pad for use in accordance with the invention can be very simply constructed as an inflatable, flexible envelope comprising a conduit extending back and forth across the pad. The pad can be constructed from films of plastic sheet material welded at their perimeters to form the envelope and forming the conduit by partially welding the films together in a series of parallel weld lines.

Preferably, a first pump is provided to circulate air through the circuit and a second, larger capacity pump is connected to the circuit and is operated intermittently to increase inflation pressure in the event that the sensor pad indicates that the sets of cells are insufficiently inflated.

According to a further aspect of the invention, therefore, there is provided an alternating pressure pad which comprises at least two sets of inflatable cells, an air supply line to each set, a first pump to circulate air alternately through a circuit including said sets and return air to said first pump, a sensor pad positioned to detect inadequate inflation pressure in said sets, a second pump connected to said circuit and detecting means for detecting a pressure change in the sensor pad or in air conduits connected thereto and for causing said second pump to be actuated in the event of reduction of pressure below a predetermined level.

Preferably, the inflatable cells are arranged in at least two sets of interposed cells, e.g. an interdigitated arrangement as described in U.S. Pat. No. 5,396,671. Conveniently, there are one or more layers of interdigitated cells, preferably contained within a cover that is waterproof and provides an easily cleaned and disinfected surface. Such an arrangement is described in the above U.S. patent and has the advantage that if the cells in the two or more layers are disposed such that a deflating cell is juxtaposed beneath or above an inflating cell, the user of the mattress is less likely to touch the underlying support surface during any part of the alternating cycle.

According to a still further aspect of the invention, therefore, there is provided an alternating pressure pad comprising a plurality of inflatable cells arranged in at least two sets of interdispersed cells, means for alternately inflating and deflating the cells, a pressure sensor arranged to sense the flow of air through the cells, a pump for inflating the cells and circulating pressurized air through the cells, and control means for controlling the operation of the pump according to the flow of air through the sensor and to increase air pressure in the cells in the event that pressure in the sensor falls below a predetermined value.

The construction of the cells, the header tubes feeding the cells, the cover for containing the cells, means for fixing the components together, the value means for alternately deflating and inflating the cell sets and other details of the construction of the mattress may be as described in the above U.S. Pat. No. 5,396,671.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
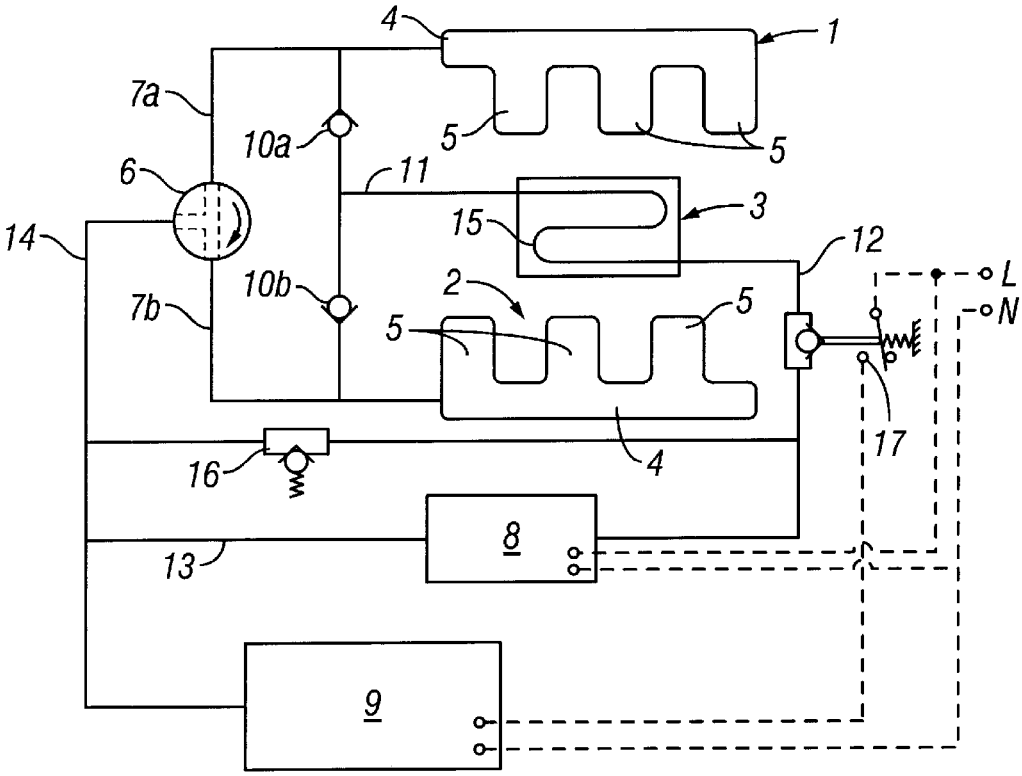
FIG. 1 is a circuit diagram of an alternating pressure pad in accordance with the invention.

Referring to FIG. 1, the alternating pressure pad comprises two sets 1 and 2 of inflatable cells. These cells are preferably constructed as longitudinal headers 4 and interdigitated finger-like cells 5 having a form as described in U.S. Pat. No. 5,396,671. A sensor pad 3 is positioned to lie beneath the mattress formed by the sets 1 and 2. The inflatable sets 1 and 2 are connected to a rotary valve 6 by air input lines 7*a* and 7*b*. Rotary valve 6 is fed with air from low power circulation pump 8 or larger powered main inflation pump 9.

Circulation pump 8 may be a diaphragm pump having a relatively low output capacity, whereas main inflation pump 9 may be an axial or centrifugal rotary pump of higher output. Check valves 10*a* and 10*b* are located between air lines 7*a* and 7*b* to prevent inflation air leaking between the air lines 7*a* and 7*b* . An air line 11 feeds the sensor pad 3 and a feedback line 12 returns air to the low output circulation pump 8. Circulation pump 8 feeds air along air line 13 and air line 14 to the rotary valve 6. The sensor pad includes a flexible, compressible tube 15.

Because of the arrangement of the check valves 10*a* and 10*b*, there is always a flow of air through tube 15 of sensor pad 3, and around the circuit that includes the circulation pump 8 and the rotary valve 6. Rotary valve 6 is driven by an electric motor (not shown), at a speed that is adjustable to provide the desired alternating supply of air to pressure lines 7*a* and 7*b* . The rotation speed may be altered to provide a desired delay period between inflation and deflation periods.

The rotary valve 6 may include a position in which both sets of cells 1 and 2 are in communication so that the inflated set equalizes pressure with the deflated set before the set to be deflated is partially or fully vented, in a further valve position, to atmosphere. This arrangement ensures a saving in the volume of air required to be fed to the circuit and thus reduces the air output capacity required from the pumps. It also reduces the pressure required in the line 12 when starting up the pump 9 for inflation of previously deflated cells.

Figure 3:
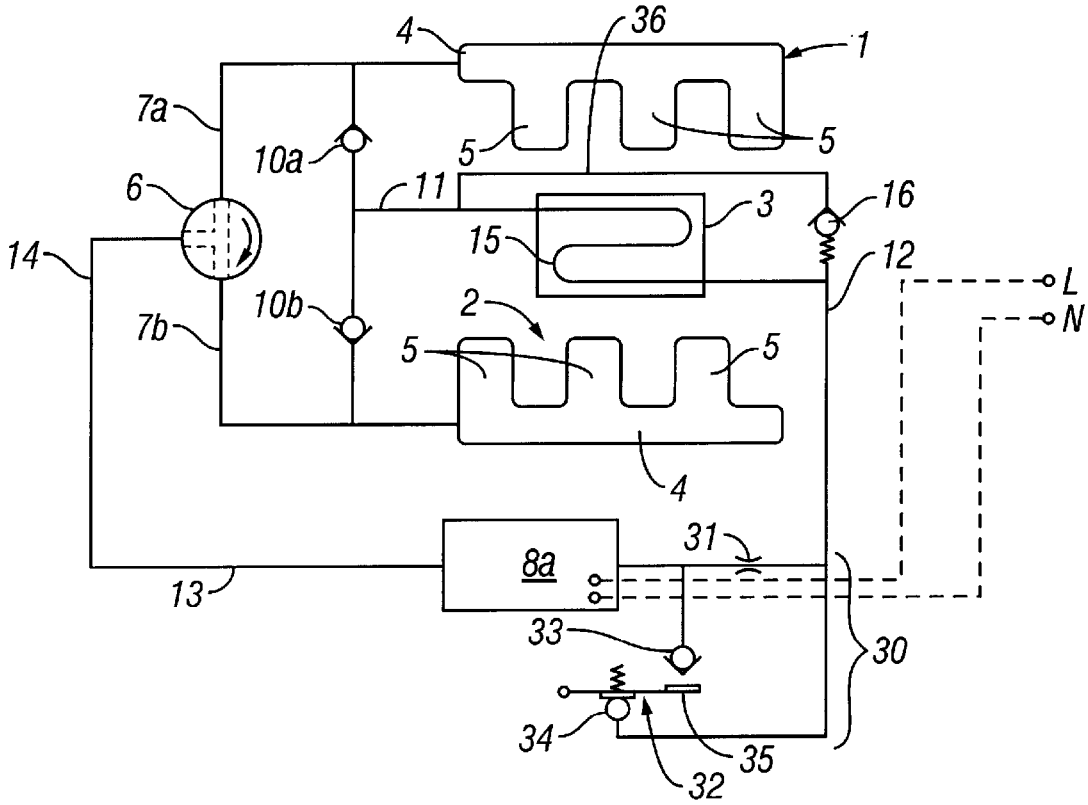
FIGS. 3 and 4 are circuit diagrams of modified alternating pressure pads of the invention.

The circuit also includes a pressure limit valve 16, which bridges the feedback line 12 with the input line 14 of the valve 6. The purpose of the pressure limit valve 16 is to leak to atmosphere in the event that the pressure in the circuit reaches an unacceptably high level. Alternatively, the pressure limit valve may connect the feedback line 12 with the input line 11, as shown in FIG. 3.

A pressure sensitive switch 17 is located in the feedback line 12 and is arranged to sense a reduction in pressure in the feedback line 12. In the event of a reduction of pressure in this line, switch 17 causes the electrical feed to the main inflation pump 9 to be actuated, thereby causing the main inflation pump to feed air to the input line 14.

The system works in the following manner. When the alternating pressure pad is in normal use, air under pressure will be alternately supplied by the pump 8 to sets 1 and 2. Pump 9 is normally actuated only on start up of the apparatus. The air from one or both pumps enters the cells alternately, and returns to the circulation pump 8 via the feedback line 12.

If the weight of the patient on the sensor pad exceeds the pressure of air within the pad, the tube 15 will collapse and close off the passage of air through the line 12. This will cause the pressure to fall in the feedback line 12, which will be sensed by the pressure switch 17. On actuation of the switch 17, the main inflation pump 9 will be actuated and this will supply air along the line 12 to the rotary valve 6 and restore the pressure within the sets 1 and/or 2.

Once pressure is restored in the inflatable cells, the patient will be lifted off the sensor pad. This will restore the flow of air through the lines 11, 15 and 12, and the increased pressure will open switch 17, thereby causing the main inflation pump 9 to be switched off. The switch 17 is preferably adjusted so that the switch is held in the off position when the pressure in the feedback line 12 is sufficient to indicate a normal flow of air through line 12. On reduction of the pressure to a level indicative of insufficient inflation of the cells 1 and 2, switch 17 may be arranged to close under a spring-bias to cause activation of the pump 9.

Figure 2:
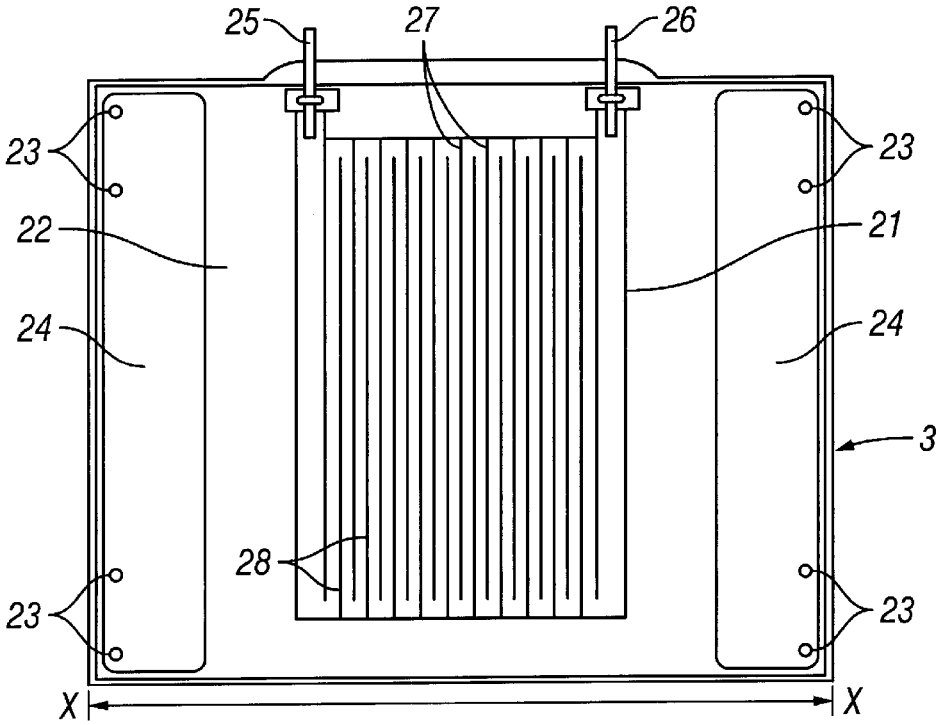
FIG. 2 is a plan view showing the construction of the sensor pad.

A preferred construction of the sensor pad is shown in FIG. 2. Referring to FIG. 2, the sensor pad 3 comprises an inflatable envelope 21, supported on a backing sheet 22. The backing sheet 22 is preferably a sheet of plastic material which has a dimension X—X approximately corresponding to the width of a bed or other suitable base support intended to support the inflatable mattress. Backing sheet 22 is fitted with fixing means, such as press-studs 23, attached through a reinforcing strip 24. The fastening means 23 are intended to be attached to the surface of the bed, or other underlying support for the inflatable mattress, under a moderate lateral tension designed to keep the surface of the backing sheet 22 flat and the pressure pad 21 unkinked.

Envelope 21 is formed with inlet and outlet connectors 25 and 26 for connection with the air line 11 and feedback line 12. The tube effectively passing between the connectors 25 and 26 consists of an elongated tube formed by partially welding thermoplastic sheets, forming the envelope 21, along weld lines 27 and 28, thereby forming an elongated tube in zig-zag formation within the envelope 21.

Although this design of sensor pad 3 is less likely to kink in use because of rucking of the sensor pad 3 beneath the patient, the over-pressure valve 16 prevents the sacs from being raised to an unacceptably high pressure should there be an unexpected blockage in the circuit. The pressure limit valve is conveniently housed together with the rotary valve 6 and the air switch 17 in the same casing, preferably together with one or both pumps. Alternatively, the pressure limit switch is located adjacent the mattress air input or feedback connection lines.

The circulation pump 8 is preferably a diaphragm-type pump, which has the advantage of requiring low power and creating a low level of noise. The pressure relief may be set to relieve pressure within the system at a pressure of about 70 mm Hg water gauge.

The rotary valve can also be provided with a setting in which both inflatable cell sets are inflated, with no leakage to atmosphere. In this setting the main electrical supply to the pump can be disconnected and the patient may be transported from one part of the hospital to another while comfortably supported on the inflated mattress.

The main inflation pump will only operate intermittently. This has the following advantages:

1. Because there is less air pressure dumped or leaked from the system and thus a lower power demand, this enables the equipment to be used at least for a part of the time with a battery power supply.

2. As air is exhausted to atmosphere at only one point in the sequence of the rotary valve, and air from the cell set to be deflated is first transferred to the non-inflated set, there is a further economy on leakage of air to atmosphere.

FIG. 3 shows a modification of the circuit shown in FIG. 1. In FIG. 3, the air circuit is the same as in FIG. 1 with the following changes. In FIG. 3, the same reference numerals are used for parts that are the same as those shown in FIG. 1. As can be seen in FIG. 3, a pressure relief valve is provided by the line 36, which bridges air lines 11 and 12 and has a pressure limit valve 16 therein. This pressure relief valve 16 functions in exactly the same way as the valve 16 in FIG. 1.

In the embodiment of FIG. 3, there is only one pump 8*a* providing for circulation of air through the system. The pump 8*a* will be a larger output pump than the pump 8 in FIG. 1 and may, for example, be a pump able to operate at different speeds to increase the air output.

In FIG. 3, a pressure-sensitive control system 30 is provided. This system will be activated if the pressure of air flowing through the sensor pad is restricted by the patient's weight. Corrective action will then be automatically taken. The control system comprises an air flow restrictor 31, connected to the inlet to the pump 8*a* . The control system also includes a control assembly 32. The assembly includes a one-way valve 33, connected to the air inlet line to the pump 8*a* between the restrictor 31 and the pump 8*a* . Valve 33 is under the control of a pressure-sensitive switch 34 and is acted on by a seal or plate 35.

In use, air is pumped by the single pump 8*a* at, say, 5 liters per minute to the rotary valve 6 and alternately passed to the two cell sets. If the weight of the patient causes the sensor line to be constricted, a small portion of air is drawn via restrictor 31 to deflate valve 34, and so open valve 33. Air is now drawn into the circuit from atmosphere through valve 33 and increases the flow rate to the cell sets until the flow rate is back to the intended level, whereupon the control system reverts to the sealed condition. If the sensor pad becomes completely blocked, air will flow via the bypass line and valve 16 to open the control system.

Figure 4:
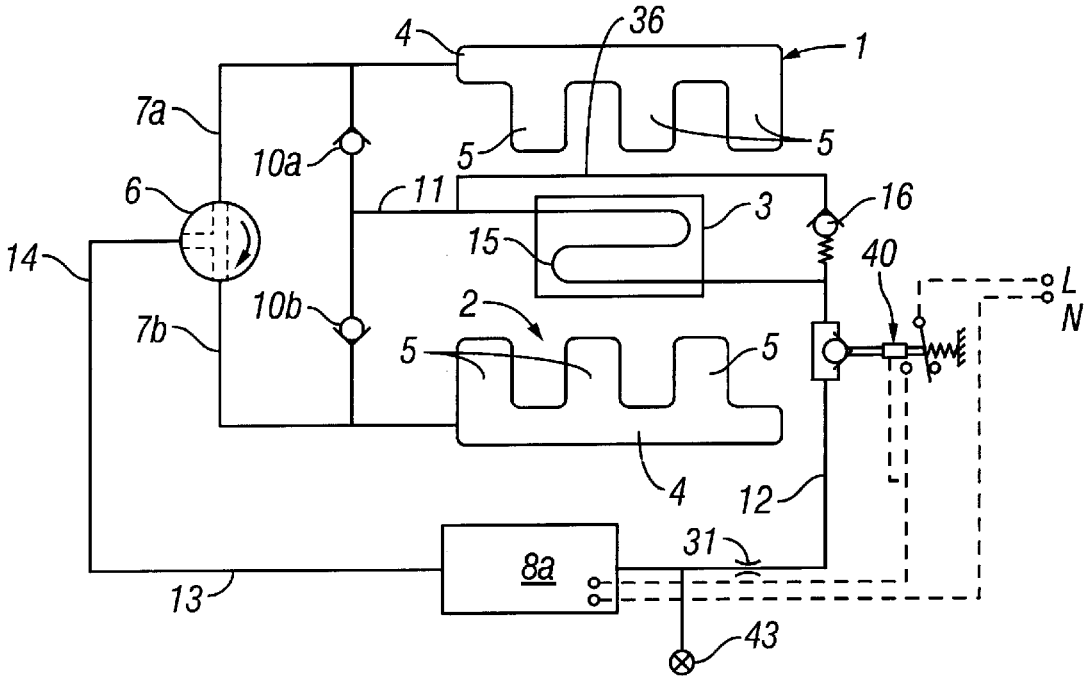

In the embodiment of FIG. 4, the pump 8*a* is a two-speed pump and the air circuit is as shown in FIG. 3 except for the pressure-sensitive control system. The feedback line 12 incorporates an air operated switch 40 set to reduce the voltage to the pump when the pressure reaches approximately 50 mm Hg and to increase the voltage when the pressure falls below approximately 25 mm Hg. When the air flow through the sensor is reduced, the air switch 40 is thrown and the pump then runs at full speed, drawing air partly from the atmosphere via a valve 43 and partly by the restrictor 31.

When the flow of air through the sensor is restored, air in the line 12 returns to full pressure and the switch is then actuated to reduce the voltage supplied to the pump 8*a* . Air will now be exhausted slowly through the circuit, the rotary valve 6 being arranged to transfer a little air at the time when the deflated cells are about to inflate, to activate the switch to run the pump at full speed during inflation of the previously deflated cells. If at any time the sensor becomes completely blocked, the air is directed via the bypass line to throw the switch 40 and thereby adjust the operation of the pump appropriately.

While the foregoing description is exemplary of the preferred embodiments of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. An alternating pressure pad, comprising:

a first set of inflatable cells having a first supply line in fluid communication therewith;

a second set of inflatable cells having a second supply line in fluid communication therewith;

a first pump in fluid communication with said first and said second sets of inflatable cells for alternately inflating and deflating said first and second sets of inflatable cells;

a sensor pad positioned and adapted to detect inadequate inflation pressure in said first and said second sets of inflatable cells; and a second pump in fluid communication with said first and said second sets of inflatable cells, said second pump being actuable upon detection through said sensor pad of inadequate inflation pressure in said first and said second sets of inflatable cells.

2. The alternating pressure pad as recited in claim 1, further comprising a detector adapted to detect changes in pressure in said sensor pad.

3. The alternating pressure pad as recited in claim 2, wherein said second pump operates intermittently in response to a change in pressure detected by said detector to below a first predetermined level.

4. The alternating pressure pad as recited in claim 3, wherein said second pump is adapted to cease operation in response to a change in pressure detected by said sensor to above a second predetermined level, said second predetermined level being greater than said first predetermined level.

5. The alternating pressure pad as recited in claim 1, wherein said first and said second sets of inflatable cells comprise fingers, said fingers of said first set being interposed between said fingers of said second set.

6. The alternating pressure pad as recited in claim 5, wherein said sensor pad is positioned substantially beneath said interposed fingers of said first and said second sets of inflatable cells.

7. The alternating pressure pad as recited in claim 1, further comprising a valve interposed between said first pump and said first and second sets of inflatable cells, said valve being adapted to alternately provide fluid communication between said first pump and said first set of inflatable cells and between said first pump and said second set of inflatable cells.

8. The alternating pressure pad as recited in claim 7, wherein said valve is further adapted to provide fluid communication between said first and said second sets of inflatable cells.

9. The alternating pressure pad as recited in claim 8, further comprising a controller operable for adaptively supplying varying degrees of fluid inflation to said first and said second sets of inflatable cells.

10. The alternating pressure pad as recited in claim 9, wherein said controller is adapted to vary the rate at which said valve switches between operating positions.

11. The alternating pressure pad as recited in claim 9, wherein said controller is adapted to actuate said second pump upon detection through said sensor pad of inadequate inflation pressure in said first and said second sets of inflatable cells.

* * * * *

UNITED STATES PATENT AND TRADEMARK OFFICE

CERTIFICATE OF CORRECTION

PATENT NO. : 6,928,681 B1
DATED : August 16, 2005
INVENTOR(S) : Peter Charles Stacy It is certified that error appears in the above-identified patent and that said Letters Patent is hereby corrected as shown below:

Column 2,
Line 49, should read -- components together, the valve means for alternately deflat- --.

Signed and Sealed this

Eighteenth Day of October, 2005

JON W. DUDAS
*Director of the United States Patent and Trademark Office*